US005492187A

United States Patent [19]

Neukirchen et al.

[11] Patent Number: 5,492,187

[45] Date of Patent: Feb. 20, 1996

[54] TWIST DRILL

[75] Inventors: Axel Neukirchen, Munich, Germany; Rainer Batliner, Schaanwald, Liechtenstein; Maximilian Stöck, Azmoos; Ralf Baumann, Gams, both of Switzerland

[73] Assignee: Hilti Aktiengesellschaft, Schaan, Liechtenstein

[21] Appl. No.: 341,776

[22] Filed: Nov. 18, 1994

[30] Foreign Application Priority Data

Nov. 18, 1993 [DE] Germany ..... 43 39 245.8

[51] Int. Cl.[6] ..... E21B 10/44; E21B 10/46

[52] U.S. Cl. ..... 175/394; 175/415

[58] Field of Search ..... 175/394, 415, 175/323, 435; 408/230

[56] References Cited

U.S. PATENT DOCUMENTS

| | | | |
|---|---|---|---|
| 2,259,611 | 10/1941 | Burger | 408/230 |
| 3,187,825 | 6/1965 | Bower, Jr. | 175/323 X |
| 4,817,743 | 4/1989 | Greenfield et al. | 175/435 |
| 4,889,200 | 12/1989 | Moser | 175/394 |
| 4,893,875 | 1/1990 | Lonn et al. | 175/435 X |
| 4,950,108 | 8/1990 | Roos | 408/230 X |
| 5,399,051 | 3/1995 | Aken et al | 408/230 X |

FOREIGN PATENT DOCUMENTS

| | | | |
|---|---|---|---|
| 367010 | 1/1923 | Germany | 408/230 |
| 384720 | 11/1923 | Germany | 408/230 |
| 2348874 | 4/1975 | Germany | 175/394 |
| 636768 | 5/1950 | United Kingdom | 175/394 |

*Primary Examiner*—Hoang C. Dang
*Attorney, Agent, or Firm*—Anderson Kill Olick & Oshinsky

[57] ABSTRACT

A rock drill has an axially elongated shank (1) with a hard metal drill head (2) secured at one end. The transverse cross-section of the drill head is basically rectangular with cutters located along each of two diagonals of its cross-section. The cutters remove drillings from rock. The cutters include a main cutter (4) and two auxiliary cutters (5, 6) having the same rotational envelope curve.

15 Claims, 3 Drawing Sheets

TWIST DRILL

BACKGROUND OF THE INVENTION

The present invention is directed to a twist drill or rock drill with an axially elongated drill shank having grooves in its outer surface for conveying drillings and with a hard metal drill head at one end of the shank.

It is well known that rock drills wear out very rapidly in the drill head region when drilling hard rock and using high rpms. Accordingly, such rock drills are formed of hard metal, and in the present case the term "hard metal" includes sintered or fused carbides, silicides, borides or their alloys.

Such a rock drill is disclosed in DE-AS 20 08 825. This rock drill has an elliptically shaped drill head formed of hard metal and soldered to the drill shank and cooperates with the shank by means of a mortise joint with the joint being formed by a tenon-shaped extension of the drill head soldered in a bore in the drill shank appropriately dimensioned in its diameter and depth.

In such a rock drill a continuous removal of the drilling takes place between intermediate spaces formed between the smallest diameter of the elliptical drill head and the inside wall of the borehole. There are two such intermediate spaces which become smaller in the region of the largest diameter of the drill head. Drillings conveyed through the intermediate spaces tend to jam in the narrowing section of the intermediate spaces located diametrically opposite one another, so that premature wear or damage to the drill head occurs in the circumferential region of the largest diameter. Apart from premature mechanical wear of the drill head, the drilling gap between the circumference of the drill head and the borehole wall causes an enlargement at the bore and a rough borehole surface.

SUMMARY OF THE INVENTION

Therefore, the primary object of the present invention is to provide a twist drill or rock drill with a hard metal drill head distinguished by a high drilling output, a high useful life and a thorough removal of the drillings.

In accordance with the present invention, the transverse cross-section of the drill head located between the end of the drill shank to which it is attached and its drilling end surface is formed by the cross-section located between two basically circular segment-like recesses disposed diametrically opposite one another and extending in the drill axis direction for effecting the flow of the drillings to the grooves in the outside surface of the drill shank adjacent to the drill head end of the shank. Further, a main cutting edge extends along one of the diagonals of the drill head cross-section and has a flattened arrowhead-like sloping roof-shaped configuration.

Because of the circular segment-like recesses formed on opposite sides of the drill head, wedging or jamming of the drillings between the circumferential region of the drill head and the borehole surface is prevented. The cross-section of the drill head extending perpendicularly to the drill axis is basically rectangular. The main cutting edge extends along one diagonal of the rectangular cross-section. This main cutting edge is located at the drilling end surface of the drill head so that, when viewed in the rotational direction of the drill head, the cutting edge of the main cutter lies closer to one of the recesses than the other face of the main cutter to the other recess. The region of the drill head facing away from the main cutting edge serves as a backup of the main cutter during the drilling operation.

The comminution of the drillings can be improved when the drillings removed by the principal cutter are comminuted by additional cutting edges.

Accordingly, in a preferred embodiment the drill head has at least two auxiliary cutters positioned essentially parallel to the other diagonal of the drill head cross-section. During the drilling process, the drillings removed by the main cutter are projected into the outer circumferential region of the drill head. To achieve a satisfactory comminution of the drillings by the auxiliary cutters, such cutters are located rotationally symmetrical in the outer side region of the drill head. Due to the rotational symmetry of the auxiliary cutters, the requisite smooth running of the drill of the rock drill is attained.

Since the additional comminution of the drillings must occur rapidly after their removal by the main cutter, it is appropriate that the main cutter comes into engagement with the rock in the rotational direction of the drill head before the drillings reach the auxiliary cutters.

In addition to the primary removal of the drillings, the main cutter serves to center the rock drill during the drilling operation. The main cutter is configured in a flattened arrowhead-like sloping roof-shaped manner, wherein the apex point or line forms the region of the drill head which has the largest spacing from the adjacent end of the drill shank viewed in the axial direction of the rock drill. The auxiliary cutters also serve for the removal of drillings from the material being drilled in addition to their comminution of the drillings removed by the main cutter. Therefore, it is preferably if the main cutter and the auxiliary cutters are located in the same envelope curve. If the auxiliary cutters must only comminute the drillings, then the auxiliary cutters can be offset axially rearwardly relative to the envelope curve formed by the main cutter.

Satisfactory removal of the drillings is dependent mainly upon the diameter of the drill head, that is, the larger the diameter of the drill head the smaller it is possible to make the recesses. To achieve adequate removal of the drillings, the cross-sectional surface of the recesses is preferably in the range of 0.6 to 0.9 times the cross-sectional area of the drill head.

The connection of the drill head with the drill shank is made by welding or soldering with the interpositioning of the solder. The trailing end of the drill head, facing the drill shank and opposite the drilling end surface preferably has a planar configuration. Such a configuration especially facilitates the soldering process, since the liquid solder can distribute itself uniformly upon the planar trailing end side oriented in a horizontal manner.

It is known that a soldered seam stressed at a right angle to the solder seam direction in tension and compression fails in a brittle manner. Contrary thereto shear stressing leads to an elastic and plastic behavior of the soldered seam. To prevent or avoid unforeseen premature flaws or failures, which arise during actual operation because of peak loads and thus increase fatigue strength, an elastic and plastic behavior of the soldered seam is desired.

The shock waves developed during actual use extend in the axial direction of the rock drill. To achieve a reduction of the tension-compression stresses leading to failure of the soldered seam, it is preferable to orient the soldered seam obliquely of the axis of the rock drill. To provide a soldered seam with a plane extending mainly obliquely of the axis of the rock drill, the trailing end face of the drill head joined to the drill shank has a recess cooperating with a correspondingly-shaped leading end side of the drill shank, with the recess having at least two element lines. The element lines extend from the mouth region of the recess towards a common center located on the axis of the drill head.

To provide the connecting surfaces between the drill shank and the drill head as large as possible, the recess in the drill head is preferably cone-shaped, sloping roof-shaped or spherically cap-shaped. A flattened arrowhead-like sloping roof-shaped recess has two element lines or surfaces which extend from the mouth region of the recess and taper towards a common center line extending through the axis of the drill head.

Cone-shaped or spherical cap-shaped recesses provide a plurality of element lines in their circumferential area with such lines extending from the mouth region of the recess and tapering inwardly toward a common center located on the axis of the drill head.

To transmit very high torque from the drill shank to the drill head, the junction between the trailing end of the drill head affording the connection with the leading end of the drill can, in a preferred manner, form rotary entrainment surfaces. Such entrainment surfaces can be formed by grooves extending at least partially across the diameter of the drill head or by centrally disposed recesses extending in the axial direction with a polygon-like cross-section.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there are illustrated and described preferred embodiments of the invention.

DETAILED DESCRIPTION OF THE INVENTION

Figure 1:
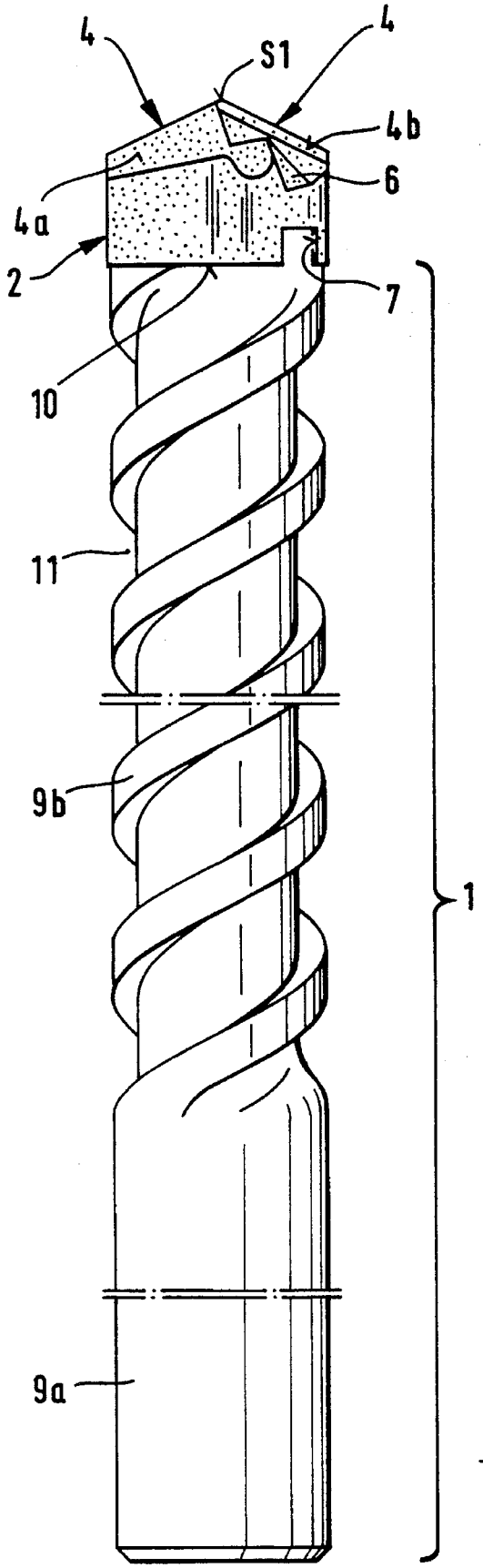
FIG. 1 is an axially extending elevational view of a rock drill embodying the present invention.
Figure 2:
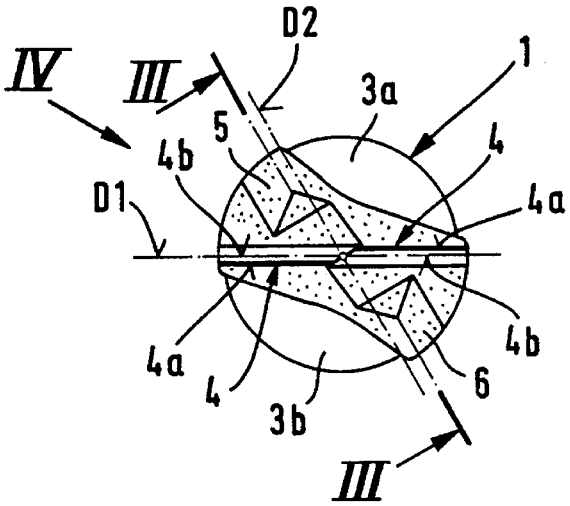
FIG. 2 is an end view of the leading or drilling end of the rock drill shown in FIG. 1.

A rock drill is illustrated in FIGS. 1 and 2 and comprises an axially elongated drill shank 1 with helical grooves 11 in its outer surface for conveying drillings from a drill head 2. The drill shank 1 and drill head 2 each have a leading end, the upper end in FIG. 1 and a trailing end, the lower end in FIG. 1. Drill shank 1 has a chucking or insertion end 9*a* at is trailing end and a conveying helix 9*b* forming its outer surface and located between the grooves 11. As viewed in FIG. 2, it can be noted that the cross-section of the drill head 2 extending transversely of the axial direction of the drill is basically rectangular with two diagonally opposite corners flaring outwardly from the remainder of the generally planar sides. A diagonal D1 extends between two corners of the cross-section with a main cutter 4 extending parallel with the diagonal. Two opposite sides of the rectangular cross-section are rounded and form the largest outside diameter of the drill head slightly larger than the outside diameter of the drill shank 1.

Figure 3:
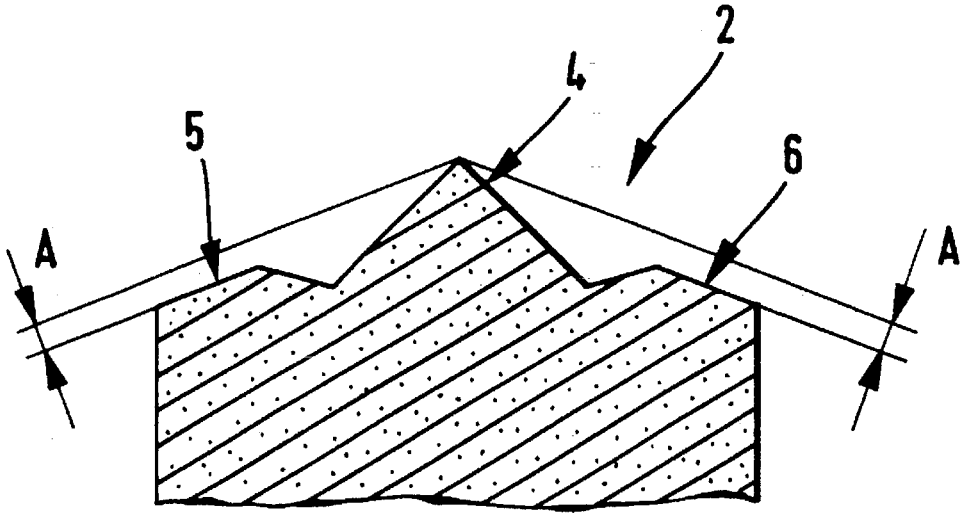
FIG. 3 is an enlarged sectional view taken along line III—III in FIG. 2.

The main cutter 4 has a flattened arrowhead-like sloping roof shape, note FIG. 3, and the apex point or line S1 of the main cutter is that region spaced furthest from the leading end face of the drill shank 1.

FIG. 2 shows a preferred arrangement of the main cutter 4 relative to the transverse cross-section of the drill head 2. As viewed in FIG. 2, the drill head rotates counterclockwise and the main cutter has a cutting edge 4*a* and a flank or surface 4*b* below the cutting edge 4*a* and facing opposite to the rotational direction. In the circumferential region of the drill head the cutting edge 4*a* of the main cutter 4 is disposed closer to one of a pair of recesses 3*a*, 3*b* located on opposite sides of the drill head than the corresponding flank 4*b* of the main cutter 4 facing toward the other recess 3*b*. As can be noted in FIG. 2, the apex point or line S1 has a linear dimension extending obliquely from one section of the cutting edge 4*a* to another section of the cutting edge located on the opposite side of the diagonal D1. In FIG. 2 the rectangular cross-section of the drill head 2 has a second diagonal D2 extending between the outwardly flaring corners of the generally planar sides of the cross-section. Auxiliary cutters 5, 6 extend partially along the second diagonal D2 and extend from the outer circumference or surface of the drill head towards and spaced from the center of the drill head 2. The auxiliary cutters 5, 6 also have a flattened arrowhead-like sloping roof-shaped surface, note FIG. 3.

As can be seen in FIG. 3, two outwardly sloping lines of the main cutter 4 describe an envelope curve formed by the main cutter as it rotates. The auxiliary cutters 5, 6 are spaced rearwardly from the envelope curve by a spacing A. The transverse length of the main cutter 4 is larger than the transverse length of the auxiliary cutters 5, 6.

Figure 4:
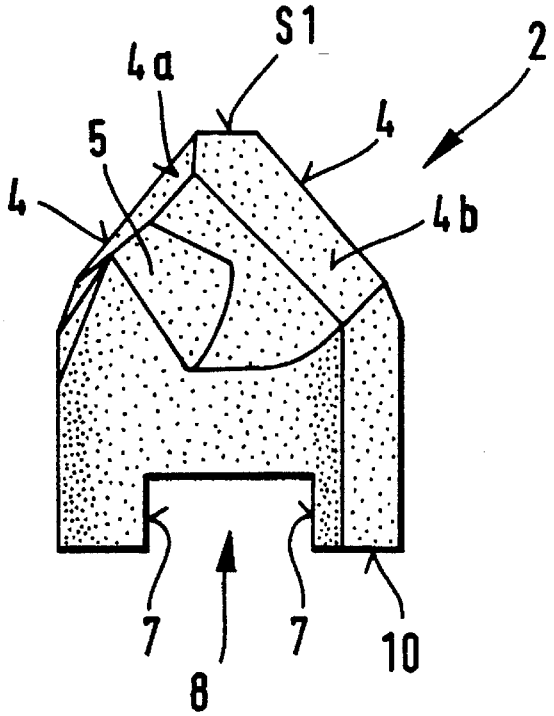
FIG. 4 is an enlarged side view of the drill head taken in the direction of the arrow IV in FIG. 2.

FIG. 4 displays the drill head 2 with one main cutter 4 and two auxiliary cutters 5 with only one auxiliary cutter illustrated. The main cutter 4 has an outwardly sloping roof-shaped configuration and a linear apex point or line S1. The trailing end 10 of the drill head 2 has a recess 8 extending transversely of the axis of the drill head. The recess 8 extends inwardly from the end face 10 in the axial direction of the rock drill. The recess 8 has a rectangular cross-section including oppositely located rotary entrainment faces 7.

Figure 5:
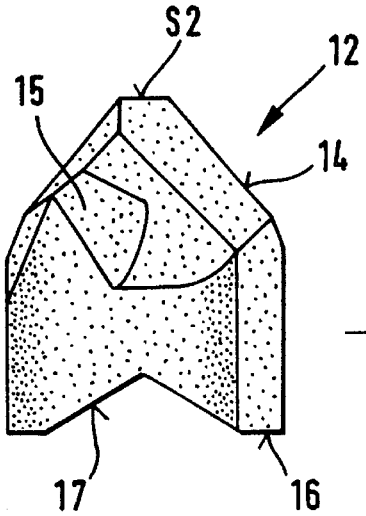
FIGS. 5, 6 and 7 are side views similar to the enlarged side view in FIG. 4 of additional drill heads embodying the present invention.

In FIG. 5, drill head 12 has a main cutter 14 and two auxiliary cutters 15, only one of which is shown. The main cutter 14 has an outwardly sloping roof-like shape and includes a linearly extending apex point or line S2. Drill head 12 has a trailing end face for connection to a drill shank, not shown, with a sloping roof-shaped recess 17.

Figure 6:
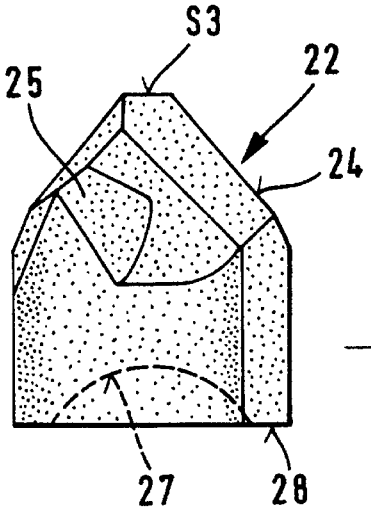

In FIG. 6 a drill head 22 is exhibited having a main cutter 24 and two auxiliary cutters 25 only one of which is shown. Main cutter 24 has an outwardly sloping roof-like with a linearly extending apex point or line S3. Trailing end face 28 of the drill head 22 has a recess 27, shown in dashed lines, shaped in the manner of a spherical cap.

Figure 7:
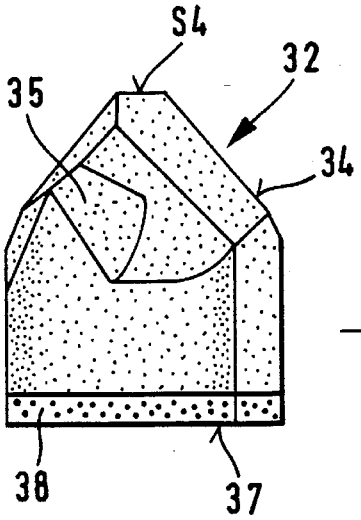

In FIG. 7 a drill head 32 is illustrated with a main cutter 34 and two auxiliary cutters 35, only one of which is shown. The main cutter 34 has a sloping roof-shaped configuration, as in FIGS. 4, 5, and 6, and a linear apex point or line S4.

The trailing end face of the drill head 32 in FIG. 7 is a planar surface extending generally perpendicularly of the drill axis. The connection of the drill head 32 with a drill shank, not shown, is effected by welding or soldering. For this purpose, the drill head 32 is formed mainly of cobalt powder and tungsten carbide can be provided in the region of the trailing end face 37 with a layer 38 consisting merely of cobalt powder, which results in an improved soldered or welded connection.

While specific embodiments of the invention have been shown and described in detail to illustrate the inventive principles, it will be understood that the invention may be embodied otherwise without departing from said principles.

We claim:

1. Rock drill comprising an axially elongated drill shank (1) having a first end and a second end, an outside surface, and a cross-sectional area extending transversely of the axial direction thereof, a drill head (2, 12, 22, 32) is formed of hard metal and has a drilling surface and an opposite end surface spaced axially from said drilling surface and secured to the first end of said drill shank, grooves (11) are formed in the outside surface of said shank and extend from the first end thereof towards the second end for conveying drillings from said drill head, wherein the improvement comprises that said drill head (2) has a cross-sectional area extending transversely of the axial direction of said shank smaller than the cross-sectional area of said shank with said first end of said shank forming two circularly segment-like surfaces each on an opposite side of said drill head and the projection of said segment-like surfaces to the drilling surface of said drill head forming a pair of axially extending recesses (3*a*, 3*b*), on opposite sides of said drill head, each of said recesses (3*a*, 3*b*) registers in the axial direction with one of said grooves at the first end of said shank, said drilling surface of said drill head having a first diagonal located between corners thereof with a main cutter extending along said first diagonal and having a flattened arrowhead-like sloping roof-shaped configuration, said drill head has a generally rectangularly-shaped transverse cross-section with two opposite rounded sides projecting outwardly from said drill shank (1) and two other side surfaces extending between said rounded surfaces and said other side surfaces being planar-shaped, said cross-section of said drill head has four corners with said first diagonal extending between a first pair of said corners and a second diagonal extending between a second pair of said corners, said main cutter having cutting edges extending parallel with said first diagonal with a first section of said main cutting edge located on one side of said first diagonal and a second section of said main cutting edge located on an opposite side of said main diagonal and with a linear apex extending obliquely of said main cutting edge between said first and second sections.

2. Rock drill, as set forth in claim 1, wherein said drill head 1 has at least two auxiliary cutters (5, 6, 15, 25, 35) extending parallel to said second diagonal.

3. Rock drill, as set forth in claim 2, wherein said auxiliary cutters (5, 6, 15, 25, 35) are arranged rotationally symmetrical on the drilling surface of said drill head (2, 12, 22, 32).

4. Rock drill, as set forth claim 1, 2 or 3, wherein said drill head has a rotational direction, said main cutter (4, 14, 24, 34) in the rotational direction of said drill head (2, 12, 22, 32) contacts a receiving material to be drilled before the receiving material is contacted by said auxiliary cutters (5, 6, 15, 25, 35).

5. Rock drill, as set forth in claim 4, wherein said main cutter (4, 14, 24, 34) forms an envelope curve in rotation of said drill head (2, 12, 22, 32) and said auxiliary cutters (5, 6, 15, 25, 35) are located basically on the same envelope curve.

6. Rock drill, as set forth in claim 1, 2 or 3, wherein the cross-sectional area of said segment-like surfaces and of said recesses (3*a*, 3*b*) are in the range of 0.6 to 0.9 times the cross-sectional area of said drill head (2, 12, 22, 32).

7. Rock drill, as set forth in claim 6, wherein said opposite end surface of said drill head is planar extending substantially perpendicularly to the axis of said drill shank and forms the surface for connecting said drill head to said drill shank.

8. Rock drill, as set forth in claim 6, wherein the opposite end surface (10, 16, 28) of said drill head (2, 12, 22) is connected to the first end of said drill shank (1) and includes a recess (8, 17, 27) cooperating with a correspondingly shaped protuberance on said drill shaft (1) and said recess comprises at least two element lines extending from the opposite end surface towards a common center located on the axis of said drill head (2, 12, 22).

9. Rock drill, as set forth in claim 8, wherein said recess (17, 18) is cone-shaped.

10. Rock drill, as set forth in claim 8, wherein said recess (17, 18) has a flattened arrowhead-like groove-shaped configuration.

11. Rock drill, as set forth in claim 8, wherein said recess (27) has a spherical cap-shape.

12. Rock drill, as set forth in claim 1, 2 or 3, wherein the opposite end surface (10) of said drill head (2) comprises rotary entrainment faces (7) extending in the axial direction of said drill head.

13. Rock drill, as set forth in claim 1, wherein said drilling surface of said drill head has a pair of auxiliary cutters extending generally parallel to said second diagonal and each located on an opposite side of said second diagonal from the other.

14. Rock drill, as set forth in claim 1, wherein a flank (4*b*) of said main cutter (4) extends along said main cutter and faces opposite to the direction of rotation of said drill head.

15. Rock drill, as set forth in claim 13, wherein said auxiliary cutters have a smaller radial dimension than said cutting edges (4*a*) of said main cutter.

* * * * *